US008965008B2

(12) United States Patent
Nyström

(10) Patent No.: US 8,965,008 B2
(45) Date of Patent: Feb. 24, 2015

(54) METHOD FOR DRIVING A CONDENSER MICROPHONE

(75) Inventor: Martin Nyström, Hörja (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 413 days.

(21) Appl. No.: 13/391,892

(22) PCT Filed: Mar. 4, 2011

(86) PCT No.: PCT/EP2011/001083

§ 371 (c)(1),
(2), (4) Date: Feb. 23, 2012

(87) PCT Pub. No.: WO2012/119610

PCT Pub. Date: Sep. 13, 2012

(65) Prior Publication Data

US 2012/0224722 A1 Sep. 6, 2012

(51) Int. Cl.

| | |
|---|---|
| ***H04R 3/00*** | (2006.01) |
| ***H04R 25/00*** | (2006.01) |
| ***H04R 19/04*** | (2006.01) |

(52) U.S. Cl.

CPC ..... *H04R 3/007* (2013.01); *H04R 19/04* (2013.01); *H04R 2410/07* (2013.01)

USPC ..... 381/111; 381/113; 381/114; 381/122; 381/174; 381/191

(58) Field of Classification Search

CPC ..... H04R 3/00; H04R 19/04; H04R 3/007; H04R 19/005; H04R 24/00; H04R 24/07; H04R 25/00

USPC ..... 381/111, 113, 122, 114, 55, 150, 174, 381/191, 147

See application file for complete search history.

(56) References Cited

U.S. PATENT DOCUMENTS

| | | | | |
|---|---|---|---|---|
| 7,548,626 | B2 * | 6/2009 | Stenberg et al. | 381/113 |
| 7,620,189 | B2 * | 11/2009 | Lang et al. | 381/113 |
| 7,787,642 | B2 * | 8/2010 | Baker et al. | 381/113 |
| 8,134,375 | B2 * | 3/2012 | Boom | 324/679 |
| 2006/0008097 | A1 | 1/2006 | Stenberg et al. | |

(Continued)

FOREIGN PATENT DOCUMENTS

EP 2 214 421 A1 8/2010

OTHER PUBLICATIONS

International Search Report and Written Opinion dated Nov. 28, 2011 issued in corresponding PCT application No. PCT/EP2011/001083, 12 pages.

(Continued)

*Primary Examiner* — Vivian Chin
*Assistant Examiner* — David Ton
(74) *Attorney, Agent, or Firm* — Synder, Clark, Lesch & Chung, LLP

(57) ABSTRACT

A method for driving a condenser microphone is provided. The condenser microphone comprises a membrane and an electrode constituting a capacity. A polarization voltage is applied between the membrane and the electrode. According to the method, an electrical signal generated by the condenser microphone based on a received acoustic signal causing a deflection of the membrane) is detected, and the polarization voltage is varied in response to the detected electrical signal.

13 Claims, 1 Drawing Sheet

(56) References Cited

U.S. PATENT DOCUMENTS

| | | | |
|---|---|---|---|
| 2009/0180644 | A1 | 7/2009 | Jiang |
| 2010/0315272 | A1 | 12/2010 | Steele et al. |

OTHER PUBLICATIONS

International Preliminary Report on Patentability dated Sep. 19, 2013, issued in corresponding PCT application PCT/EP2011/001083.

* cited by examiner

METHOD FOR DRIVING A CONDENSER MICROPHONE

The present invention relates to a method for driving a condenser microphone, a control circuit for a condenser microphone, a condenser microphone, a mobile device, and a headset.

BACKGROUND OF THE INVENTION

A condenser microphone, which is also called capacitor microphone or electrostatic microphone, is an acoustic to electric transducer or sensor that converts sound into an electrical signal. Condenser microphones are used in a wide variety of applications, for example telephones, mobile phones, studio microphones and headsets.

The condenser microphone comprises a moveable membrane and an electrode or two electrodes. The membrane is arranged in parallel and spaced apart from the electrode or between the two electrodes. The arrangement of membrane and electrode(s) is called capsule. The membrane as well as the electrode are electrically conducting. Thus, a capacity is constituted. The value of the capacity depends on the area of the membrane and the electrode, and a distance between the electrode and the membrane. Intruding sound makes the membrane swing and thus the distance between the membrane and the electrode is changed. There are two operating modes for evaluating the change of capacity: The direct current (DC) biased mode and the radio frequency (RF) or high frequency (HF) mode. With the DC-biased mode the membrane and the electrode are biased with a fixed charge and a voltage maintained across the membrane and the electrode changes with the vibrations of the membrane. The RF or HF mode uses a comparatively low RF voltage generated by a low noise oscillator, at a frequency of several MHz, for example 8 MHz. The membrane and the electrode are part of a resonant circuit that modulates the frequency of the oscillator signal. Demodulation yields a low-noise audio frequency signal with a very low sound impedance.

However, due to the small distance between the membrane and the electrode, a dynamic range of the condenser microphone is limited and distortions are present when the membrane is largely deflected or touches the electrode. Furthermore, as microphones in general are sensitive to wind noise or acoustic pressure of high value and low frequency, also condenser microphones are sensitive to wind noise.

Therefore, there is a need for an improvement in operating a condenser microphone which makes the condenser microphone more robust against wind noise, increases the dynamic range of the condenser microphone, and reduces distortions.

SUMMARY OF THE INVENTION

According to the present invention, this object is achieved by a method for driving a condenser microphone as defined in claim 1, a control circuit for a condenser microphone as defined in claim 8, a condenser microphone as defined in claim 10, a mobile device as defined in claim 11, a headset as defined in claim 13, and a studio microphone as defined in claim 14. The depending claims define preferred and advantageous embodiments of the present invention.

According to an aspect of the present invention a method for driving a condenser microphone is provided. The condenser microphone comprises a membrane and an electrode constituting a capacity. A polarization voltage is applied between the membrane and the electrode. According to the method an electrical signal generated by the condenser microphone is detected. The electrical signal is based on a received acoustic signal which causes a deflection of the membrane. Furthermore, according to the method, the polarization voltage is varied in response to the detected electrical signal. For example, the polarization voltage may be varied such that it causes a mechanical force on the membrane, and the mechanical force counteracts a current deflection of the membrane. Thus, the dynamic range of the condenser microphone may be extended.

According to another embodiment, the membrane is arranged in a minimal deflected position when no acoustic signal is acting on the membrane. Varying the polarization voltage includes applying a voltage which causes a mechanical force on the membrane which urges the membrane to the minimal deflected position. This keeps the membrane in the minimal deflected position, the so-called middle position, and avoids a distortion as the membrane is operated near the middle position. The minimal deflected position may comprise a non-deflected position when no acoustic signal is acting on the membrane.

According to another embodiment varying the polarization voltage comprises applying a voltage on the membrane that causes a mechanical force on the membrane which urges the membrane away from the electrode when the electrical signal indicates that a current deflection of the membrane in the direction of the electrode is larger than a predetermined threshold. Thus, when the membrane is in danger to come into contact with the electrode, the membrane is kept away from the electrode by the electrically induced mechanical force. This may be useful when strong wind noise is applied to the condenser microphone.

According to another embodiment, the polarization voltage comprises a direct current voltage and varying the polarization voltage comprises adjusting a voltage level of the direct current voltage. Thus, the condenser microphone may be operated in the above-described DC-biased mode. Furthermore, the condenser microphone may be operated in the above-described radio frequency (RF) or high frequency (HF) mode. In this case, originally no direct current polarization voltage is needed for sound extraction from the capsule, so a direct current voltage across the membrane and the electrode(s) is added to the radio frequency or high frequency voltage to create the electrically induced force on the membrane. Thus, the condenser microphone may be operated in each of the above-described operating modes, as applicable, and may utilize the above-described advantageous method.

According to a further embodiment, an output signal is generated in response to the electrical signal and the polarization voltage. When the polarization voltage is varied, the electrical signal does not linearly represent the acoustic signal any more. Based on the polarization voltage this non-linearity may be compensated and a compensated output signal may be generated.

According to another aspect of the present invention, a control circuit for a condenser microphone is provided. The condenser microphone comprises a membrane and an electrode constituting a capacity. The control circuit comprises a polarization voltage supply unit for applying a variable polarization voltage between the membrane and the electrode. The control circuit comprises furthermore a control unit adapted to detect an electrical signal which is generated by the condenser microphone based on a received acoustic signal. The received acoustic signal causes a deflection of the membrane. The control unit is furthermore adapted to control the polarization voltage supply unit to vary the polarization voltage in response to the detected electrical signal.

The control circuit may be adapted to perform the above-described method and comprises therefore the above-described advantages.

According to another aspect of the present invention, a condenser microphone is provided. The condenser microphone comprises a membrane, an electrode arranged spaced apart from the membrane, and the above-described control circuit. The membrane and the electrode constitute a capacity. The condenser microphone comprises the same advantages as the above-described method.

According to another aspect of the present invention, a mobile device is provided which comprises a condenser microphone as defined above. The mobile device may comprise a mobile telephone, a personal digital assistant, a mobile navigation system, a mobile computer or a mobile music player.

Finally, according to another aspect, a headset comprising the condenser microphone as described above is provided.

Although specific features described in the above summary and the following detailed description are described in connection with specific embodiments, it is to be understood that the features of the embodiments can be combined with each other unless specifically noted otherwise.

BRIEF DESCRIPTION OF THE DRAWINGS

The invention will now be described in more detail with reference to the accompanying drawings.

DETAILED DESCRIPTION OF PREFERRED EMBODIMENTS

In the following, exemplary embodiments of the present invention will be described in more detail. It has to be understood that the following description is given only for the purpose of illustrating the principles of the invention and is not to be taken in a limiting sense. Rather, the scope of the invention is defined only by the appended claims and not intended to be limited by the exemplary embodiments hereinafter.

It is to be understood that the features of the various exemplary embodiments described herein may be combined with each other unless specifically noted otherwise. Same reference signs in the various instances of the drawings refer to similar or identical components.

Figure 1:
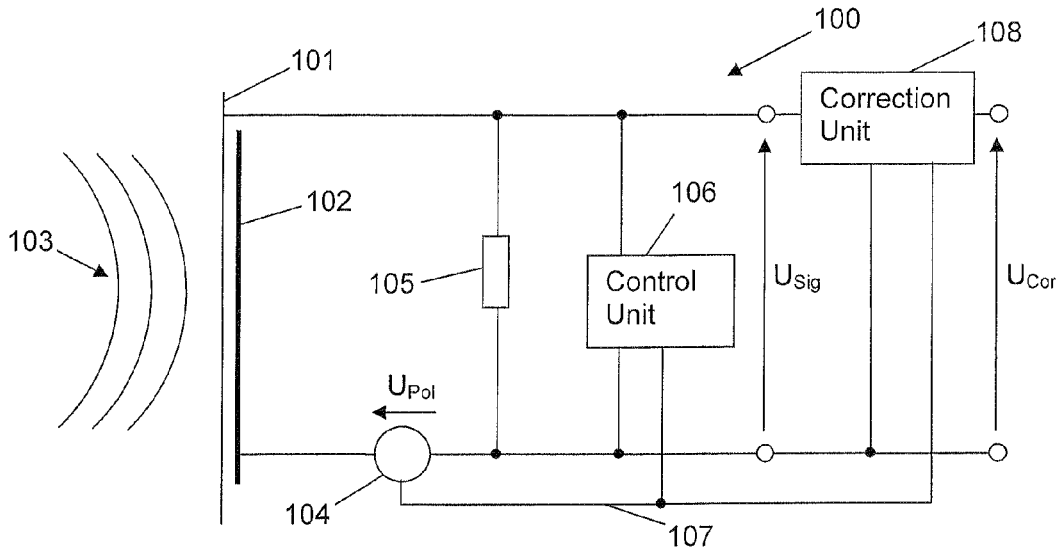
FIG. 1 shows a block diagram of a condenser microphone according to an embodiment of the present invention.

FIG. 1 schematically shows a block diagram of a condenser microphone 100. The condenser microphone comprises a membrane 101 and an electrode 102. The membrane 101 and the electrode 102 are arranged in parallel and spaced apart from each other such that the membrane 101 may swing or oscillate when acoustic noise 103 is applied to the membrane 101. The electrode 102 is rigid such that it is essentially not swinging or oscillating due to the acoustic noise 103. The membrane 101 and the electrode 102 are electrically conducting elements and arranged electrically insulated from each other. The distance between the membrane 101 and the electrode 102 defines a capacity.

The condenser microphone 100 comprises furthermore a polarization voltage supply unit 104 generating a polarization voltage $U_{Pol}$. The polarization voltage supply unit 104 applies the polarization voltage $U_{Pol}$ over a resistor 105 to the capacity constituted by the membrane 101 and the electrode 102. As described above in the background of the invention, due to the acoustic noise 103 the capacity of the arrangement of the membrane 101 and the electrode 102 is varied and a corresponding electrical signal $U_{Sig}$ is generated either in the direct current operating mode (DC) or the radio frequency operating mode (RF).

Figure 2:
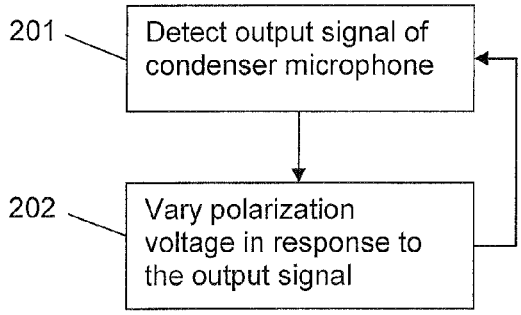
FIG. 2 shows a flow chart of a method for driving a condenser microphone according to an embodiment of the present invention.

The condenser microphone 100 comprises furthermore a control unit 106 which is connected to the electrical signal $U_{Sig}$ and to the polarization voltage supply unit 104. Via the connection 107 between the control unit 106 and the polarization voltage supply unit 104 the polarization voltage supply unit 104 can be controlled via a control signal from the control unit 106. FIG. 2 shows the control loop for controlling the polarization voltage supply unit 104. In step 201 the control unit 106 detects the electrical output signal $U_{Sig}$ of the condenser microphone 100 and in response to the detected signal $U_{Sig}$ the polarization voltage supply unit 104 is varied in step 202. In the direct current operating mode (DC) a voltage level of the direct current polarization voltage of the polarization voltage supply unit 104 is adjusted. In the radio frequency or high frequency operating mode (RF or HF) a direct current voltage is added to the oscillating voltage of the polarization voltage supply unit 104.

By varying the polarization voltage a mechanical force between the membrane 101 and the electrode 102 may be generated or varied. The mechanical force may provide an attraction between the membrane 101 and the electrode 102, for example by applying a different polarity between the membrane 101 and the electrode 102, or a repulsion, for example by applying the same polarity to the membrane 101 and the electrode 102.

As soon as the polarization voltage is varied, the detected signal $U_{Sig}$ is no longer linear with respect to the received acoustic noise 103. The unlinearity induced by the change of the polarization voltage is predictable and can be compensated in later filtering stages. Therefore, as shown in FIG. 1, the condenser microphone 100 may comprise a correction unit 108 coupled to the detected signal $U_{Sig}$ and the connection 107 providing the control signal controlling the polarization voltage. The correction unit 108 contains knowledge about how the control signal affects the detected signal $U_{Sig}$, so a reverse transformation may be conducted and a corrected output signal $U_{Cor}$ may be generated and output by the correction unit 108.

The mechanical force may be used to control a membrane deflection in the following ways:

First, the mechanical force may be used to keep the membrane 101 as close to a centered position as possible independent of sound pressure. Therefore, a wider dynamic range of the condenser microphone may be achieved. The maximum sound pressure level (SPL) before the membrane hits or touches the electrode may be increased with the counterforce from the electric feedback of the control unit 106.

In the following some exemplary figures of improvements for a condenser microphone are given. However, these exemplary figures are not to be taken in a limiting sense. For example, a measurement microphone usually may provide a dynamic range from the noise floor at 14 dB (A) to 134 dB as maximum SPL, resulting in a dynamic range of 120 dB. As preliminary calculations indicate, this dynamic range may be increased by 10 dB by the above-described counterforce from the feedback from the control unit 106. Furthermore, when the condenser microphone 100 comprises two electrodes 102 sandwiching the membrane 101 between the two electrodes 102, the dynamic range may be increased by more than 40 dB. However, the increased dynamic range cannot only be used to increase the maximum sound pressure level, but may also reduce noise floor by allowing microphone constructions which are normally prohibited by saturation at very low sound pressure levels. For example, a small condenser microphone may have a noise floor at 30 dB (A) and a maximum sound pressure level of 120 dB, giving a range of 90 dB. This range may be increased by approximately 16 dB with the proposed feedback method for a condenser microphone with a single electrode 102.

Furthermore, distortion from non-flat movements of the membrane 101 may by eliminated or reduced. In condenser microphones the membrane is fixed along its outer circular edge. For small sound pressure level the membrane moves like a piston, but for large excursions or deflections the membrane will form a bent shape, giving a non-linear transduction from sound pressure to output voltage resulting in a distortion or non-linearity. If the membrane is kept in the middle even for higher sound pressure levels, distortions due to bent-shaped deflections of the membrane are eliminated or reduced. The dynamic range increase and the distortion reduction may be used to increase performance in measurement systems, in high quality audio recordings. Furthermore, the same method may be used to improve performance of very small condenser microphone units allowing to build smaller condenser microphones without reducing performance.

Second, the mechanical force fed back from the control unit 106 may serve as a wind saturation protection. In windy conditions, the membrane 101 sometimes reaches the electrode 102 causing a non-linear output which is very difficult to eliminate by later filtering techniques. By controlling the polarization voltage $U_{Pol}$ such that a mechanical force keeps the membrane 101 away from the electrode 102 prohibits such large deflections caused by wind. When the voltage swing of the output signal $U_{Sig}$ indicates that the membrane 101 is close to the electrode 102, a counterforce is applied by changing the polarization voltage $U_{Pd}$.

Figure 3:
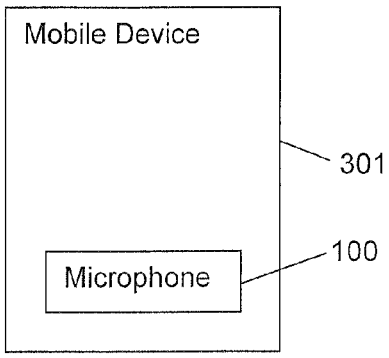
FIG. 3 shows a mobile device comprising a condenser microphone according to an embodiment of the present invention.

The above-described condenser microphone 100 may be used for example in a headset or, as shown in FIG. 3, in a mobile device 301.

While exemplary embodiments have been described above, various modifications may be implemented in other embodiments. For example, as already indicated above, the condenser microphone 100 may comprise two electrodes 102 which are arranged in parallel and enclose the membrane 101 in between the electrodes 102. One pole of the polarization voltage supply unit 104 is connected to both electrodes 102 and the other pole of the polarization voltage supply unit 104 is connected via the resistor 105 to the membrane 101.

Finally, it is to be understood that all the embodiments described above are considered to be comprised by the present invention as it is defined by the appended claims.

The invention claimed is:

1. A method for driving a condenser microphone, wherein the condenser microphone comprises a membrane and at least one electrode constituting a capacity, and wherein a polarization voltage is applied between the membrane and the at least one electrode, the method comprising:

detecting an electrical signal generated by the condenser microphone based on a received acoustic signal causing a deflection of the membrane, varying the polarization voltage in response to the detected electrical signal, and generating an output signal in response to the electrical signal and the polarization voltage, wherein the generated output signal has been compensated for non-linearity induced variation of the polarization voltage.

2. The method according to claim 1, wherein varying the polarization voltage comprises applying a voltage causing a mechanical force on the membrane counteracting a current deflection of the membrane.

3. The method according to claim 1, wherein the membrane is arranged in a minimal deflected position when no acoustic signal is acting on the membrane, wherein varying the polarization voltage comprises applying a voltage causing a mechanical force on the membrane urging the membrane to the minimal deflected position.

4. The method according to claim 1, wherein varying the polarization voltage comprises applying a voltage causing a mechanical force on the membrane urging the membrane away from the at least one electrode when the electrical signal indicates that a current deflection of the membrane in the direction of the at least one electrode is larger than a predetermined threshold.

5. The method according to claim 1, wherein the polarization voltage comprises a direct current voltage, wherein varying the polarization voltage comprises adjusting a voltage level of the direct current voltage.

6. The method according to claim 1, wherein the polarization voltage comprises a high frequency voltage, wherein varying the polarization voltage comprises adding a direct current voltage to the high frequency voltage.

7. The method according to claim 1, wherein the at least one electrode comprises two electrodes arranged in parallel, wherein the membrane is sandwiched between the two electrodes, and wherein the polarization voltage is applied between the membrane and the two electrodes.

8. A control circuit for a condenser microphone, wherein the condenser microphone comprises a membrane and at least one electrode constituting a capacity, the control circuit comprising:

a polarization voltage supply unit for applying a variable polarization voltage between the membrane and the at least one electrode, wherein the control circuit is configured to detect an electrical signal generated by the condenser microphone based on a received acoustic signal causing a deflection of the membrane, and to control the polarization voltage supply unit to vary the polarization voltage in response to the detected electrical signal, and a correction unit, coupled to a control signal input of the control circuit, which is configured to control the polarization voltage supply unit, and where the correction unit is configured to receive the detected electrical signal and to generate an output signal in response to the detected electrical signal and the polarization voltage, wherein the correction unit is further configured to compensate the generated output signal for non-linearity induced variation of the polarization voltage.

9. A condenser microphone comprising:

a membrane, an electrode arranged spaced apart from the membrane, the membrane and the electrode constituting a capacity, and a control circuit according to claim 8.

10. A mobile device comprising a condenser microphone according to claim 9.

11. The mobile device according to claim 10, wherein the mobile device comprises a device selected from the group consisting of a mobile telephone, a personal digital assistant, a mobile navigation system, a mobile computer and a mobile music player.

12. A headset comprising a condenser microphone according to claim 9.

13. A studio microphone comprising a condenser microphone according to claim 9.

* * * * *